US006993145B2

(12) United States Patent
Combest

(10) Patent No.: US 6,993,145 B2
(45) Date of Patent: Jan. 31, 2006

(54) SPEAKER GRILLE FRAME

(75) Inventor: Christopher Combest, Leawood, KS (US)

(73) Assignee: Multi-Service Corporation, Overland Park, KS (US)

( * ) Notice: Subject to any disclaimer, the term of this patent is extended or adjusted under 35 U.S.C. 154(b) by 194 days.

(21) Appl. No.: 10/607,464

(22) Filed: Jun. 26, 2003

(65) Prior Publication Data

US 2004/0264730 A1 Dec. 30, 2004

(51) Int. Cl.
*H04R 25/00* (2006.01)

(52) U.S. Cl. ..... 381/391; 381/189; 181/199

(58) Field of Classification Search ..... 381/189, 381/391, 332–333, 345, 353, 386, 388–389; 181/150, 199

See application file for complete search history.

(56) References Cited

U.S. PATENT DOCUMENTS

| | | | | |
|---|---|---|---|---|
| 3,952,834 | A | | 4/1976 | Soma et al. |
| D248,856 | S | | 8/1978 | Saidel |
| D253,109 | S | | 10/1979 | Kashidaira |
| 4,281,224 | A | | 7/1981 | Castagna |
| 4,974,698 | A | | 12/1990 | Smith |
| 5,058,154 | A | * | 10/1991 | Andersen ..... 379/433.02 |
| 5,244,096 | A | * | 9/1993 | Stoner ..... 206/581 |
| 5,400,407 | A | * | 3/1995 | Cassity et al. ..... 381/87 |
| 5,400,413 | A | * | 3/1995 | Kindel ..... 381/189 |
| 5,416,283 | A | * | 5/1995 | Dault et al. ..... 181/150 |
| 5,444,790 | A | * | 8/1995 | Kogen ..... 381/359 |
| 5,565,659 | A | | 10/1996 | Moner, Jr. et al. |
| 5,652,413 | A | | 7/1997 | Mulera |
| D451,499 | S | | 12/2001 | Stompler et al. |
| D455,733 | S | | 4/2002 | Stompler et al. |

* cited by examiner

*Primary Examiner*—Suhan Ni
*Assistant Examiner*—Phylesha Dabney
(74) *Attorney, Agent, or Firm*—Hovey Williams LLP

(57) ABSTRACT

A speaker grille (10) comprises a cloth (18) and a frame (20) to support the cloth (18). The cloth (18) is preferably stretched taunt over the frame (20) for minimal movement in response to speaker excursion. The frame (20) includes a plurality of sidewalls (29) defining a plurality of slots (30) through which sound waves may travel between a smooth surface (26) supporting the cloth (18) and a mounting surface (28) with which the frame (12) mounts to a speaker box (12). The slots (30) preferably penetrate all four sides of the frame (20) and may also penetrate all four corners of the frame (20). The slots (30) form channels that act as waveguides and allow sound waves to travel from speakers (16) through the frame (20). The frame (20) and the channels may be configured to direct the sound waves at various angles to the speaker box (12).

22 Claims, 2 Drawing Sheets

SPEAKER GRILLE FRAME

BACKGROUND OF THE INVENTION

1. Field of the Invention

The present invention relates to audio systems. More particularly, the present invention relates to a speaker grille frame through which sound waves may travel.

2. Description of Prior Art

Conventional speaker diaphragms are typically covered with speaker grille cloth or other perforated material to protect the diaphragm from dust and other particles. The cloth is stretched very tightly over removable frames in order to minimize movement in response to airflow created by speaker excursion. Therefore, frames must be rigid enough to withstand the tension associated with tightly stretched cloth and are typically solid and quite dense.

Unfortunately, however, solid frames block and reflect sound waves, thereby preventing sound waves from propagating along a front surface of a speaker. This creates undesirable reflections and reduces sound quality, thereby diminishing the effectiveness of advanced surround sound systems.

Accordingly, there is a need for an improved speaker grille that overcomes the limitations of the prior art.

SUMMARY OF THE INVENTION

The present invention overcomes the above-identified problems and provides a distinct advance in the art of speaker grilles. More particularly, the present invention provides a speaker grille frame through which sound waves may travel. The frame is designed as part of a speaker grille for use with a speaker box. The speaker box is preferably completely conventional and includes a plurality of speakers. The grille is preferably removably mounted to the speaker box.

The grille broadly comprises a cloth or other perforated material and a frame to support the cloth and hold the cloth offset forwardly of the speakers. The cloth is preferably stretched taunt over the frame for minimal movement in response to speaker excursion. Thus, structural integrity of the frame is a paramount consideration. The frame includes a plurality of sidewalls defining a plurality of slots through which sound waves may travel between a smooth surface supporting the cloth and a mounting surface with which the frame mounts to the speaker box. The slots are preferably rectangular in cross-section, preferably penetrate all four sides of the frame, and may also penetrate all four corners of the frame.

The slots form channels through the frame which act as waveguides and allow sound waves to travel from the speakers through the frame. In this manner, the channels direct the sound waves laterally and disperse the sound waves substantially parallel to a plane of the frame and perpendicular to the speaker axes. Furthermore, the exterior perimeter of the frame may be beveled, rounded, or otherwise modified in shape, thereby sloping or otherwise modifying the channel's shape. In this case, the sound waves may be directed at various angles to the speaker axes. Thus, the grille of the present invention may be configured to direct the sound waves at various angles between perpendicular and parallel to the speaker axes, or to diffract the sound waves around the sides of the speaker box.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
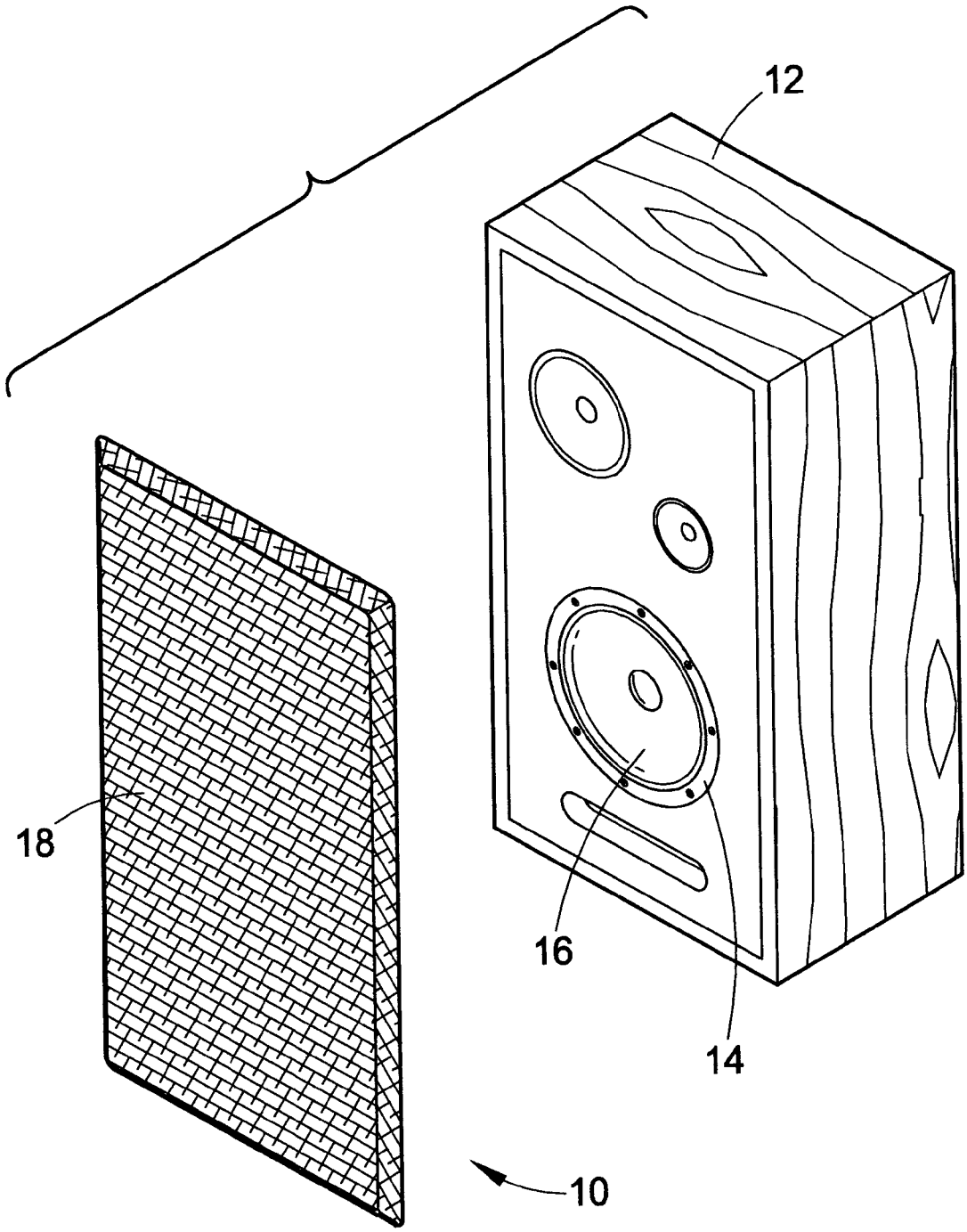
FIG. 1 is a perspective view of a speaker grille constructed in accordance with a preferred embodiment of the present invention shown with a speaker box to which the grille may removably mount.

Referring to FIG. 1, the preferred speaker grille 10 constructed in accordance with a preferred embodiment of the present invention is illustrated with a speaker box 12. The speaker box 12 is preferably completely conventional and includes a plurality of speaker openings 14 each accommodating one of a plurality of speakers 16. The grille 10 is preferably removably mounted to the speaker box 12 in virtually any conventional manner. For example, the grille 10 may include pegs that fit into holes in the speaker box 12. Alternatively, the speaker box 12 may include pegs that fit into holes in the grille 10.

Figure 2:
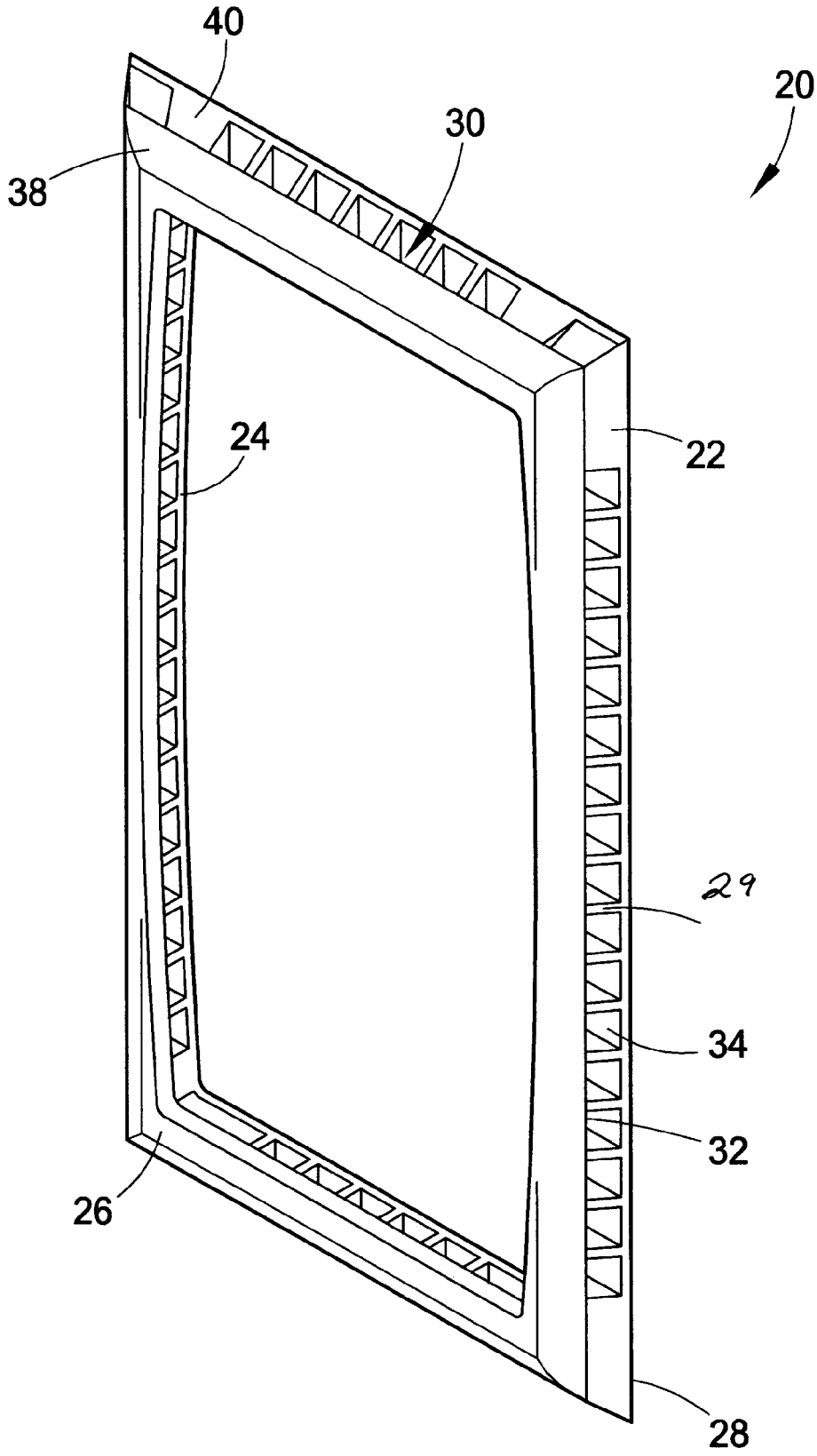
FIG. 2 is a perspective view of a frame of the grille.

Referring also to FIG. 2, the grille 10 broadly comprises a cloth 18 or other perforated material and a frame 20 to support the cloth 18 and hold the cloth 18 offset forwardly of the speakers 16. The cloth 18 may be glued, stapled, or attached to the frame 20 in virtually any conventional manner. The cloth 18 is preferably stretched over the frame 20. Thus, the cloth 18 may cover the speakers 16 with minimal movement in response to air movement caused by the speaker's 16 excursion.

The frame 20 is preferably rectangular and approximately one half inch thick. The frame 20 includes an exterior perimeter 22 and an interior perimeter 24. In one embodiment, the exterior perimeter 22 is approximately seven and one quarter inches wide and approximately thirteen and three quarter inches tall. In this embodiment, the interior perimeter 24 is approximately five and three quarter inches wide and approximately eleven and one half inches tall. However, these dimensions are dependent upon the size and shape of the speaker box 12. In addition, the exterior perimeter 22 may be beveled in order to provide a smooth transition over which the cloth 18 may be stretched.

The frame 20 presents a substantially continuous smooth surface 26 for supporting the cloth 18 and a mounting surface 28 for mating with the speaker box 12. A plurality of traversely extending sidewalls 29 define a plurality of slots 30 through which sound waves may travel between the smooth surface 26 and the mounting surface 28. The slots 30 are preferably approximately one half inch wide and approximately one quarter inch deep. Each slot 30 preferably has a rectangular cross-section with a front wall 32 adjacent the smooth surface 26, a back wall 34 adjacent the mounting surface 28. The sidewalls 29 rigidly offset the smooth surface 26 from the mounting surface 28 in order to provide the structural integrity required to support the cloth 18. In this regard, the sidewalls 29 are preferably approximately one eighth of an inch thick. However, the slots 30 preferably penetrate all four sides of the frame 20 and may also penetrate all four corners of the frame 20. With this in mind, the sidewalls 29 may be tapered near the corners of the frame 20.

The frame 20 may be constructed of two pieces. For example, a front piece 38 and a back piece 40 may each begin as solid fiberboard, or another suitable material. The pieces 38,40 may be shaped to fit the speaker box 12. The back piece 40 is also preferably configured to mate with the speaker box 12, and thus includes the mounting surface 28. The slots 30 are preferably cut into a front surface of the back piece 40, using a router, milling machine, or similar apparatus, forming the sidewalls 29 between the slots 30 and the back walls 34 separating the slots 30 from the mounting surface 28. Then, the front piece 38 may be placed over and glued to the back piece 40 to cover the slots 30, thereby providing the smooth surface 26 over which the cloth 18 may be stretched. Thus, the front piece 38 would include the smooth surface 26 and the front walls 32 of the slots 30.

The frame 20 is preferably manufactured by first cutting the slots30 in the back piece 40. Second, the interior perimeter 24 is formed in both the front piece 38 and the back piece 30. Third, the exterior perimeter 22 is formed in both the front piece 38 and the back piece 30. Fourth, the front piece 38 and the back piece 40 are glued together. Fifth, the exterior perimeter 22 is beveled. Finally, the cloth 18 is stretched over and glued to the frame 20. However, a slightly modified manufacturing order may be used.

It can be seen that the slots 30 form channels through the frame 20. The channels act as waveguides and allow sound waves to travel from the speakers 16 through the frame 20. The channels direct the sound waves laterally and disperse the sound waves substantially parallel to a plane of the frame 20. Thus, the grille 10 of the present invention allows the sound waves to propagate not only along an axis of each speaker 16, as is well known in the art, but also perpendicular to the speaker axises. Furthermore, if the exterior perimeter of the frame 20 is beveled, the front walls 32 of the slots 30 will be shorter than the back walls 34 of the slots 30. In this case, the sound waves may be directed at an acute angle to the speaker axises. Thus, the grille 10 of the present invention may be configured to direct the sound waves at various angles to the speaker axes.

While the present invention has been described above, it is understood that other materials and/or dimensions can be substituted. For example, the frame 10 may be constructed of plastic or even metal, such as aluminum, and may be circular or otherwise rounded. As discussed above, the dimensions of the perimeters 22,24 are virtually entirely dependant upon the dimensions of the speaker box 12. However, the dimensions of the slots 30 and the sidewalls 29 are critical to the structural integrity of the frame 20. With this in mind, the dimensions of the slots 30 and the sidewalls 29 are related. For example, if the slots 30 are deeper, then the sidewalls 29 are preferably thicker, which can be accommodated with narrower or fewer slots 30. Of course, these dimensions are also dependant upon the strength of the material chosen. Provided these limitations are met, the slots 30 may be between one quarter inch and one inch wide, between one eight of an inch and half an inch deep, and the sidewalls 29 may be between one sixteenth of an inch and one inch thick. These and other minor modifications are within the scope of the present invention.

Having thus described a preferred embodiment of the invention, what is claimed as new and desired to be protected by Letters Patent includes the following:

1. A speaker grille frame for use with and designed to support a cloth, the frame comprising:

a substantially continuous smooth surface for supporting the cloth;

a plurality of sidewalls behind the smooth surface and defining a plurality of slots through which sound waves may travel; and a mounting surface opposing the smooth surface and separated therefrom by the plurality of side walls, wherein the mounting surface is substantially continuous along a perimeter of the frame and is operable to mate with a speaker box in order to hold the frame over at least one speaker opening.

2. The frame as set forth in claim 1, wherein the slots are aligned substantially parallel to a plane of the frame.

3. The frame as set forth in claim 1, wherein the slots are aligned substantially perpendicular to a speaker axis.

4. The frame as set forth in claim 1, wherein the frame is rounded.

5. The frame as set forth in claim 1, wherein the frame is rectangular.

6. The frame as set forth in claim 5, wherein the slots penetrate all four sides of the frame.

7. The frame as set forth in claim 5, wherein the slots penetrate each corner of the frame.

8. The frame as set forth in claim 1, wherein the slots have rectangular cross-sections.

9. The frame as set forth in claim 1, wherein the frame is beveled around an exterior perimeter such that a back wall of each slot is longer than a front wall of each slot.

10. The frame as set forth in claim 9, wherein the frame is constructed of two pieces, including a top piece comprising the smooth surface and the front walls, and a bottom piece comprising the mounting surface, the sidewalls, and the back walls.

11. A speaker grille operable to allow passage of sound waves therethrough, the grille comprising:

a cloth; and a frame substantially completely covered by and operable to support the cloth and including a substantially continuous smooth surface for supporting the cloth, a plurality of sidewalls behind the smooth surface and defining a plurality of slots through which sound waves may travel, and a mounting surface opposing the smooth surface and separated therefrom by the plurality of side walls, wherein the mounting surface is substantially continuous along a perimeter of the frame and is operable to mate with a speaker box in order to hold the frame over a plurality of speaker openings.

12. The grille as set forth in claim 11, wherein the slots are aligned substantially parallel to a plane of the frame.

13. The grille as set forth in claim 11, wherein the frame is rounded.

14. The grille as set forth in claim 11, wherein the frame is rectangular.

15. The grille as set forth in claim 14, wherein the slots penetrate the frame through all four sides and each corner.

16. The grille as set forth in claim 11, wherein the slots have rectangular cross-sections.

17. The grille as set forth in claim 11, wherein the frame is beveled around an exterior perimeter such that a back wall of each slot is longer than a front wall of each slot.

18. The grille as set forth in claim 17, wherein the frame is constructed of two pieces, including a top piece comprising the smooth surface and the front walls, and a bottom piece comprising the mounting surface, the sidewalls, and the back walls.

19. A speaker assembly comprising:

a plurality of speakers;

a speaker box having a plurality of speaker openings operable to accept the speakers; and a speaker grille including a cloth, and a rectangular frame substantially completely covered by the cloth, the frame including a top piece comprising a smooth surface operable to support the cloth in front of the speakers, a bottom piece comprising a mounting surface operable to removably mount to the speaker box, and a plurality of sidewalls behind the smooth surface and defining a plurality of slots aligned substantially parallel to a plane of the frame through which sound waves may travel.

20. The assembly as set forth in claim 19, wherein the slots penetrate the frame through all four sides and each corner of the frame.

21. The assembly as set forth in claim 19, wherein the slots form rectangular channels through which sound waves may travel.

22. The assembly as set forth in claim 21, wherein the frame is beveled around an exterior perimeter such that a back wall of each slot is longer than a front wall of each slot.

* * * * *